US008815073B2

(12) United States Patent
Kawashita et al.

(10) Patent No.: US 8,815,073 B2
(45) Date of Patent: Aug. 26, 2014

(54) WEB PRESSURE WELDING METHOD, PRESSURE WELDING DEVICE, POWER SUPPLY METHOD, POWER SUPPLY DEVICE, CONTINUOUS ELECTROLYTIC PLATING APPARATUS AND METHOD FOR MANUFACTURING WEB WITH PLATED COATING FILM

(75) Inventors: Mamoru Kawashita, Otsu (JP); Fumiyasu Nomura, Otsu (JP)

(73) Assignee: Toray Industries, Inc., Tokyo (JP)

( * ) Notice: Subject to any disclaimer, the term of this patent is extended or adjusted under 35 U.S.C. 154(b) by 1358 days.

(21) Appl. No.: 12/532,922

(22) PCT Filed: Mar. 25, 2008

(86) PCT No.: PCT/JP2008/055482
§ 371 (c)(1),
(2), (4) Date: Sep. 24, 2009

(87) PCT Pub. No.: WO2008/123211
PCT Pub. Date: Oct. 16, 2008

(65) Prior Publication Data

US 2010/0086793 A1 Apr. 8, 2010

(30) Foreign Application Priority Data

Mar. 28, 2007 (JP) ..... 2007-083854

(51) Int. Cl.
*C25D 7/06* (2006.01)
*C25D 17/00* (2006.01)

(52) U.S. Cl.
USPC ..... 205/138; 204/198

(58) Field of Classification Search
CPC ... C25D 7/0614; C25D 7/0657; C25D 7/0664
USPC ..... 205/138; 204/198
See application file for complete search history.

(56) References Cited

U.S. PATENT DOCUMENTS 4,304,653 A * 12/1981 Winand ..... 204/206
4,772,361 A * 9/1988 Dorsett et al. ..... 205/93

FOREIGN PATENT DOCUMENTS

| | | | |
|---|---|---|---|
| JP | 59-133551 | | 9/1984 |
| JP | 61066633 | A * | 4/1986 |
| JP | 4-76309 | | 7/1992 |
| JP | 4-105048 | | 9/1992 |
| JP | 07-022473 | | 1/1995 |
| JP | 7069417 | A | 3/1995 |
| JP | 08-209383 | | 8/1996 |
| JP | 2003147582 | A | 5/2003 |
| JP | 2003-321796 | | 11/2003 |
| JP | 2004-263215 | | 9/2004 |
| JP | 2005-507463 | | 3/2005 |
| JP | 2005113173 | A | 4/2005 |
| JP | 2005-248269 | | 9/2005 |

OTHER PUBLICATIONS

International Search Report dated Jul. 8, 2008, application No. PCT/JP2008/055482.

* cited by examiner

*Primary Examiner* — Nicholas A Smith
(74) *Attorney, Agent, or Firm* — RatnerPrestia

(57) ABSTRACT

A web pressure welding method for pressure welding, with respect to a running web, a first belt-shaped annular body which contact surface rotates with running of at least one web, where an area pressure for pressure welding to the web side is applied on the contact surface of the first belt-shaped annular body.

5 Claims, 15 Drawing Sheets

【Fig.3b

WEB PRESSURE WELDING METHOD, PRESSURE WELDING DEVICE, POWER SUPPLY METHOD, POWER SUPPLY DEVICE, CONTINUOUS ELECTROLYTIC PLATING APPARATUS AND METHOD FOR MANUFACTURING WEB WITH PLATED COATING FILM

This application is a U.S. National Phase Application of PCT International Application No. PCT/JP2008/055482, filed Mar. 25, 2008, which claims priority to Japanese Patent Application No. 2007-083854, filed Mar. 28, 2007, the contents of these applications being incorporated by reference herein in their entirety.

FIELD OF THE INVENTION

The present invention relates to a web pressure welding method, a pressure welding device, a power supply method, a power supply device, a continuous electrolytic plating apparatus, and a method for manufacturing a web with a plated coating film.

BACKGROUND OF THE INVENTION

Conventionally, a method of contacting a conductive surface of a web or a metal web to a cathode roller, arranging a plating bath in which an anode is immersed in a plating solution is arranged on the front or the back, and forming a plate film in the plating bath is known as a method of continuously forming a plate film on the web while running the web such as a plastic film. If the plate film is continuously formed on the web through such method, a plate film of a desired thickness, which is easily thickened on the web, can be formed by repeatedly passing a unit arranged with a cathode-anode (see patent document 1).

In recent years, a wiring substrate of a mode in which a web of polyimide film or polyester film and a copper foil are combined is given attention for a flexible circuit substrate used in electronic devices, electronic parts, semiconductor packages, and the like. Such substrate includes a substrate normally called a "three-layer type" in which a copper foil is laminated to the web by way of an adhesive, and a flexible circuit substrate normally called a "two-layer type" in which the metal film is formed through plating and the like on the web without interposing an adhesive. The latter two-layer type is given more attention with advancement in miniaturization of the wiring pitch of the circuit.

The current situation related to such flexible circuit substrates is as follows. The three-layer type print circuit substrate uses epoxy resin or acryl resin for the adhesive, and thus has a drawback in that the electrical characteristic degrades by the impurity ion contained in the resin. Furthermore, since the heat resistance temperature of the adhesive is between 100° C. and 150° C., such high heat resistance (higher than or equal to 300° C.) cannot be sufficiently exhibited even if polyimide is used for the base film material, whereby spec down of the heating temperature inevitably occurs in wire bonding etc. to the IC chip requiring high temperature mounting. Moreover, since the general film thickness of the copper film is 18 μm or 35 μm in the three-layer type print circuit substrate, the copper is too thick and the etching rate significantly lowers when performing patterning at smaller than or equal to a pitch of 80 μm (copper wiring 40 μm, gap 40 μm), whereby the circuit width on the surface side of the copper film and the circuit width on the adhesive surface side differs significantly or significant thinning occurs as a whole by etching and the target circuit pattern may not be obtained.

In recent years, in order to solve the problems of the three-layer type, the substrate normally called the "two-layer type" obtained by electrolyte copper plating after depositing various types of metals deposited on the web surface through various depositions methods such as PVD method including vacuum deposition method, sputtering method or various ion plating method, so-called CVD method of vaporizing and depositing chemicals containing metal, and the like without interposing an adhesive, or after plating various types of metals through an electroless plating method is proposed. The two-layer substrate has characteristics in that the copper film thickness can be freely changed through the electrolyte copper plating such as the circuit pattern having a pitch of 40 μm can be easily formed if the copper film thickness is 8 μm, and in that the heat resistance temperature of various types of webs can be reflected as it is.

From the above situations, demands on the film with a plated coating film are increasing. However, since the web is run while contacting the conductive surface to the cathode roller in the conventional method, scratches and burr-like protrusions involved therewith sometimes are produced at the very delicate conductive surface of the web. Furthermore, since the cathode roller is contacted to the entire width of the web, the entire length of the cathode roller becomes long by an amount the width of the web is increased, whereby the roll diameter inevitably becomes large to maintain strength and the size of the power supply device itself becomes large.

In recent years, the miniaturization of the circuit pattern is advancing, and the surface quality required on the plate film is also becoming stricter therewith. Thus, a development of a process that does not produce microscopic scratches and protrusions is being dedicatedly carried out.

Patent document 2 proposes a plating process called a clip method in which the end of the web is sandwiched and pinched with a power supply clip, and the web is passed through the plating solution in such state to perform plating on the web, where microscopic scratches and the like do not produce in the product as only the end of the web, which is not manufactured, is gripped, and a satisfactory surface quality can be obtained. However, a large conveyance system for running the power supply clip, a large additional facility for deplating step of removing the plate film precipitated on the power supply clip, and the like are required. The foreign substances floating in the plating solution become the cause of plating defects called zara and thus high cleanliness is required for the plating solution, but the plating solution tends to be easily polluted by foreign substances such as abrasion powder since various movable parts are arranged on the upper part of the plating solution. Furthermore, plating is not performed on the portion to be gripped with the power supply clip and the resistance value becomes large at the relevant portion since the film thickness of the electrically conductive film becomes thin only at the relevant portion, whereby problems such as change in color and alteration arise at the periphery by the Joule heat when large current is flowed.

Patent document 3 proposes a method of supplying power while pressing a plate spring-shaped power supply electrode to the end of the web and performing plating on the web, where satisfactory surface quality with fewer scratches etc. is similarly obtained in the product according to such method. However, the plating solution and the peripheral devices are polluted by the abrasion powder at the same time as the abrasion of the electrode since the power supply electrode is constantly in a rubbing state. Since a brake is constantly applied by the electrode, an uneven tensile distribution produces in the width direction of the web, which is a large problem from the standpoint of stable running.

Patent document 4 illustrates a general vertical plating device using a roll-shaped power supply electrode, and proposes a so-called dumbbell-shaped power supply electrode in which the outer diameter of the roller at the central part is reduced so that only the ends contact the web as one type of a cathode roller shape. According to such method, a product with lesser surface defects such as scratches at the central part of the web where the roller does not contact can be manufactured. However, since the angular speed of the roller is the same at both ends, a peripheral speed difference creates at both ends if the outer diameter of both ends contacting the web does not match even by a small amount, and thus an extremely high processing accuracy is required. If the outer diameter does not match by any possibility, the abrasion of the electrode and production of tensile distribution in the width direction occur as one of the ends contact while sliding.

Patent document 5 proposes a method of supplying power by exposing only the upper end of the web from the plating bath and closely attaching the belt-shaped electrode to the exposed portion without contacting the central part of the web to perform plating without affecting characteristics such as bulkiness of nonwoven cloth. According to such method a swell, a high quality plate film without scratches and dents at the central part is obtained. However, according to such method, the film thickness is very thin as the upper end of the web is constantly not plated, and change in color and alteration of the film occur by Joule heat when large current is flowed due to the large resistance. In the web of plastic film and the like having poor elasticity in the thickness direction, even if the web and the belt-shaped electrode are sandwiched with the guide roller and closely attached with the nip force, the contact resistance of the electrode and the web at other than the nipped location becomes large as close attachment force only generates at the guide roller portion. Thus, problems by heat arise when large current is flowed.

Patent document 6 proposes a conveyance method of pressing a rotating body of small width on a conveyance roller, where the rotating body also acts as a power supply electrode. A product with fewer scratches at the surface opposite to the surface wrapped to the conveyance roller can be manufactured by installing the rotating body at the end of the web as a power supply electrode using such method. However, according to the knowledge of the inventors of the present invention, a roller of hard material needs to be used as folding wrinkles produce at the web with the edge of the electrode if a soft material is used for the material of the conveyance roller in such method, and thus problems of scratches may not be resolved at the surface wrapped to the conveyance roller.

Patent document 1: Japanese Unexamined Patent Publication No. 7-22473

Patent document 2: Japanese Patent Publication No. 2005-507463

Patent document 3: Japanese Unexamined Patent Publication No. 2005-248269

Patent document 4: Japanese Unexamined Patent Publication No. 2003-321796

Patent document 5: Japanese Unexamined Patent Publication No. 8-209383

Patent document 6: Japanese Unexamined Patent Publication No. 2004-263215

SUMMARY OF THE INVENTION

The present invention provides an electrolytic plating apparatus that does not produce microscopic defects at the surface of the plate film.

According to an embodiment of the present invention a web pressure welding method of pressure welding, with respect to a running web, a first belt-shaped annular body having a contact surface rotating with the running of at least one web, wherein an area pressure for pressure welding to the web side is applied with respect to the contact surface of the first belt-shaped annular body.

According to a preferred embodiment of the present invention, there is provided the web pressure welding method, wherein the first belt shaped annular body containing magnetic material is used, and the area pressure is applied on the contact surface of the first belt-shaped annular body by a magnetic force towards the web.

According to a preferred embodiment of the present invention, there is provided the web pressure welding method, wherein a reactive force with respect to the magnetic force is applied by a reactive force applying means arranged on an opposite side in a direction of the area pressure of the web.

According to a preferred embodiment of the present invention, there is provided the web pressure welding method, wherein the reactive force is generated by the reactive force generating means including a second belt-shaped annular body arranged and placed in a tensioned state so as to sandwich the web with the first belt-shaped annular body.

According to a preferred embodiment of the present invention, there is provided the web pressure welding method, wherein the reactive force is applied using at least one reactive force applying rotating body.

According to a preferred embodiment of the present invention, there is provided the web pressure welding method, wherein a support rotating body is arranged so as to be contacted by the first belt-shaped annular body with a wrapping angle with the web sandwiched with an outer peripheral surface of the first belt-shaped annular body to apply the area pressure.

According to a preferred embodiment of the present invention, there is provided the web pressure welding method, using plural support rotating bodies.

According to a preferred embodiment of the present invention, there is provided the web pressure welding method, wherein the area pressure is applied by ejecting fluid from an inner peripheral surface side of the first belt-shaped annular body towards an inner peripheral surface of the first belt-shaped annular body.

According to a preferred embodiment of the present invention, there is provided the web pressure welding method, wherein a reactive force with respect to the force by the area pressure is applied by a reactive force applying means arranged on an opposite side in a direction of the area pressure of the web.

According to a preferred embodiment of the present invention, there is provided the web pressure welding method, wherein the reactive force is applied using at least one reactive force applying rotating body.

According to a preferred embodiment of the present invention, there is provided the web pressure welding method, wherein the reactive force is generated by the reactive force applying means including a second belt-shaped annular body arranged and placed in a tensioned state to sandwich the web with the contact surface of the first belt-shaped annular body.

According to a preferred embodiment of the present invention, there is provided the web pressure welding method, wherein a width of the first belt-shaped annular body is narrower than a width of the web.

According to another embodiment of the present invention, there is provided a power supply method used in a continuous electrolytic plating apparatus for manufacturing a web with a plated coating film by performing electrolyte plating in a plating processing tank while continuously running a web applied with a conductive thin film on a surface, the method including the steps of pressure welding the first belt-shaped annular body to the web with the pressure welding method; and supplying power to a conductive surface of the web through the first belt shaped annular body, the reactive force applying means, or the support rotating body using a body which contact surface with the web has conductivity and is electrically connected to a plating power supply as the first belt-shaped annular body, the reactive force applying means, or the support rotating body.

According to a preferred embodiment of the present invention, there is provided the power supply method, wherein a contact area with the web conductive surface of the first belt-shaped annular body is within a range satisfying equation where

[Equation 1]

$$\frac{I^2 \cdot R}{Q_L \cdot t} \leqq A \leqq 50000 \quad \text{(Equation 1)}$$

A: contact area [$mm^2$] of contact surface to surface of conductive thin film

I: current value [A] to be input

R: contact resistance value [Ω] of contacting part t: film thickness [mm] of electrically conductive film to which the contact surface contacts $Q_L$: limit heat quantity coefficient [$W/mm^3$]=$8.5\times10^3$ $W/mm^3$ According to another embodiment of the present invention, there is provided a web pressure welding device for applying a pressure welding force to a running web, the web pressure welding device including at least one first belt-shaped annular body; at least two pulleys, arranged on an inner side and/or outer side of the first belt-shaped annular body, for applying a tensile force on the first belt-shaped annular body; and an area pressure applying means for applying an area pressure to a running path side of the web with respect to a contact surface of the first belt-shaped annular body between at least two adjacent pulleys of the pulleys at a site contacting the running path of the web of the first belt-shaped annular body.

According to a preferred embodiment of the present invention, there is provided the web pressure welding device, wherein the first belt-shaped annular body contains magnetic material, and the area pressure applying means is arranged to sandwich the running path of the web with the first belt-shaped annular body and generate an attraction force by the magnetic force with the first belt-shaped annular body.

According to a preferred embodiment of the present invention, there is provided the web pressure welding device, wherein the first belt-shaped annular body is applied with a corrosion resistance conductive thin film on a surface of the magnetic material.

According to a preferred embodiment of the present invention, there is provided the web pressure welding device, wherein the first belt-shaped annular body is applied with a corrosion resistance conductive thin film on a surface of the magnetic material, and performed with R chamfering at an edge on both ends in a width direction of the magnetic material.

According to a preferred embodiment of the present invention, there is provided the web pressure welding device, wherein a reactive force applying means for applying a reactive force with respect to the attraction force by the magnetic force is arranged between the area pressure applying means and the running path of the web.

According to a preferred embodiment of the present invention, there is provided the web pressure welding device, wherein the reactive force applying means includes at least one second belt-shaped annular body, and at least two pulleys, arranged on an inner side and/or outer side of the second belt-shaped annular body, for applying a tensile force on the second belt-shaped annular body, the contact surface contacting the running path of the web of the second belt-shaped annular body being arranged with the running path of the web in between with a site contacting the running path of the web of the first belt-shaped annular body.

According to a preferred embodiment of the present invention, there is provided the web pressure welding device, wherein the reactive force applying means is at least one reactive force applying rotating body.

According to a preferred embodiment of the present invention, there is provided the web pressure welding device, wherein the area pressure applying means is a support rotating body arranged to be contacted with the first belt-shaped annular body with a wrapping angle with the running path of the web sandwiched with the outer peripheral surface of the first belt-shaped annular body.

According to a preferred embodiment of the present invention, there is provided the web pressure welding device, comprising plural support rotating bodies.

According to a preferred embodiment of the present invention, there is provided the web pressure welding device, wherein the area pressure applying means is a fluid ejection body arranged on an inner peripheral surface side of the first belt-shaped annular body, a fluid ejection port of the fluid ejection body being configured to eject fluid towards an inner peripheral surface of the first belt-shaped annular body.

According to a preferred embodiment of the present invention, there is provided the web pressure welding device, wherein the reactive force applying means for applying a reactive force with respect to the force by ejection of the fluid is arranged on an opposite side of the area pressure applying means with the running path of the web in between.

According to a preferred embodiment of the present invention, there is provided the web pressure welding device, wherein the reactive force applying means is at least one reactive force applying rotating body.

According to a preferred embodiment of the present invention, there is provided the web pressure welding device, wherein the reactive force applying means includes at least one second belt-shaped annular body and at least two pulleys, arranged on an inner side and/or outer side of the second belt-shaped annular body, for applying a tensile force to the second belt-shaped annular body, the contact surface contacting the running path of the web of the second belt-shaped annular body being arranged sandwiching the running path of web with a site contacting the running path of the web of the first belt-shaped annular body.

According to another embodiment of the present invention, there is provided a power supply device for plating device comprising the web pressure welding device, wherein the first belt-shaped annular body, the reactive force applying means, or the support rotating body has conductivity at a surface contacting the running path of the web, and is configured as an electrode electrically connected with a plating power supply.

According to a preferred embodiment of the present invention, there is provided a continuous electrolytic plating apparatus for manufacturing a web with a plated coating film by performing electrolyte plating in a plating processing tank while continuously running a web applied with a conductive thin film on a surface, wherein the power supply device is arranged on at least one location along the running path of the web.

According to a preferred embodiment of the present invention, there is provided the electrolytic plating apparatus, further comprising a movement means for moving the first belt-shaped annular body in a width direction of the web.

According to a preferred embodiment of the present invention, there is provided the web electrolytic plating apparatus, wherein the power supply device is arranged at one or more locations outside a plating bath of before or/and after the plating tank.

According to a preferred embodiment of the present invention, there is provided the web electrolytic plating apparatus, wherein the power supply device is arranged on at least one or more location on the plating bath in the plating tank.

According to a preferred embodiment of the present invention, there is provided the web electrolytic plating apparatus, wherein the width direction of the web runs substantially parallel to a gravity direction.

According to a preferred embodiment of the present invention, there is provided the web electrolytic plating apparatus of multistage including the web electrolytic plating apparatus, a contact area to a surface of the conductive thin film of the electrode of the power supply device being smaller at the power supply device arranged on a downstream side than an upstream side, and following equation being satisfied.

[Equation 2]

$$\frac{I^2 \cdot R}{Q_L \cdot t} \leqq A \leqq 50000 \qquad \text{(Equation 1)}$$

A: contact area [$mm^2$] of the electrode to surface of conductive thin film

I: current value [A] to be input

R: contact resistance value [Ω] of contacting part t: film thickness [mm] of electrically conductive film to which the electrode contacts $Q_L$: limit heat quantity coefficient [$W/mm^3$]=$8.5\times10^3$ $W/mm^3$ According to another embodiment, there is provided a web with a plated coating film manufactured using the web electrolytic plating apparatus.

In the present invention, "belt-shaped annular body" refers to a belt-shaped and annular substance, and rotates while being guided by the pulley. For instance, the body may be a belt formed to an annular shape by cutting the belt-shaped body and connecting the ends or a so-called endless belt.

In the present invention, the "support rotating body" refers to a rotating body for regulating the displacement of the belt-shaped annular body that occurs by the force applied on the belt-shaped annular body and generating the reactive force for receiving force and obtaining a greater contact pressure. For instance, the support rotating body may be an endless belt shape similar to the belt-shaped annular body, a roller, a pulley, or the like.

In the present invention, the "reactive force applying means" is a means for regulating the displacement of the belt-shaped annular body that occurs by the force applied on the belt-shaped annular body and generating the reactive force for receiving force and obtaining a greater contact pressure. For instance, the reactive force applying means may be a means for ejecting a squeezing air so as to apply force from an opposite side of the web so as to be in a reverse direction of the force applied on the belt-shaped annular body. The support rotating body is one of reactive force applying means.

In the present invention, the "pulley" is a rotating body having a function of guiding the running of the belt-shaped annular body and a function of applying a tensile force on the belt-shaped annular body. For instance, a structure in which a bearing is arranged on an inner side of a cylinder and fitted to a fixed shaft, and an outer diameter contacts an inner surface of the belt-shaped annular body is suitably used. To prevent meandering of the belt-shaped annular body, the crown processing is preferably performed on the outer diameter of the pulley. Although the presence of drive is irrelevant, driving device for resupplying torque of an extent of compensating for the inertia of the belt-shaped annular body rotating system, the mechanical loss by sliding resistance and the like is preferably arranged.

In the present invention, the "area pressure" is the pressure generated as an area instead of a point or a line. For instance, penetrating with a needle is a "point force," and nipping with the rollers without wrapping of the web to the roller is a "linear force", which are not included in the "area force". For instance, a case of attracting a plate-shaped object such as a band to a sheet etc. using a magnetic force or a vacuum pressure, and a case of pressing a plate-shaped object using a squeezing air act as the "area force".

When sandwiching the web with two belt-shaped annular bodies and nipping with roller pair at some places without wrapping as in the technique of patent document 5, assumption is made that nipping is carried out with linear force unless the wrapping angle is greater than or equal to 5° as a result of the deformation of the roller itself or the web if the roller pair is nipped without wrapping. In this case, the location that is not directly nipped with the roller pair merely as the tensile force in the running direction applied to the belt-shaped annular body, and the pressure in the direction of directly sandwiching the web is barely applied, and thus such cases are not included in the scope of the "area force".

In the present invention, the phrase "the belt-shaped annular body contacts the roller with wrapping" refers to a state configuring a pass line of the belt-shaped annular body such that an angle (contact angle) between a line connecting one point on the outer periphery where the belt-shaped annular body starts to contact one roller and the center point and a line connecting one point on the outer periphery where the belt-shaped annular body starts to separate from the roller and the center point is greater than or equal to five degrees. When nipping with the roller pair as well, a case where the above condition is met by deforming the roller surface is also included.

Applying the area force for pressure welding to the side of the web (or running path of web) with respect to the contact surface of the belt-shaped annular body includes having the source of the pressure welding force directly acting on the belt-shaped annular body, stretching the belt-shaped annular body, arranging a member for backing up the same, having the source of the pressure welding force acting the force from the side of the web or the running path of the web towards the side of the belt-shaped annular body, and having the contact surface of the belt-shaped annular body consequently stretched or backed up act the area force to the side of the web or the running path of the web.

In the present invention, the "contact surface" refers to a surface contacting the belt-shaped annular body, the reactive force applying means, or the web of the reactive force applying rotating body.

In the present invention, the "contact resistance value" is the contact resistance of the belt-shaped annular body configuring an electrode, the reactive force applying means, or the contact surface of the reactive force applying rotating body and the conductive thin film of the web. The measurement method is as described in the first example.

In the present invention, "the width direction of the web is substantially parallel to the gravity direction" refers to a state in which the width direction of the web is the gravity direction. As a design idea of the device, assuming the web is run with the width direction of the web standing vertically instead of horizontally, this is in the scope of "substantially parallel to the gravity direction", and is included in "substantially parallel to the gravity direction" even if slightly shifted from an accurate vertical state due to influence of deflection of the web, the mechanical error, and the like. If intentionally shifted from the vertical direction, this is not included in the relevant scope.

According to an embodiment of the present invention, the belt-shaped annular body can be stably closely attached to the web surface, so that generation of surface defects such as scratches due to the relative speed difference of the belt-shaped annular body and the web can be suppressed. As the contact width of the belt-shaped annular body is narrower than the web width, the non-contacting portion obviously does not produce surface defects caused by the contact of the belt-shaped annular body, whereby the possibility of generation of surface defects can be greatly lowered.

BRIEF DESCRIPTION OF THE DRAWINGS

FIG. 3*b* is a cross-sectional view showing another example of a structure of the power supply electrode according to an aspect of the present invention;

DESCRIPTION OF SYMBOLS

Figure 1:
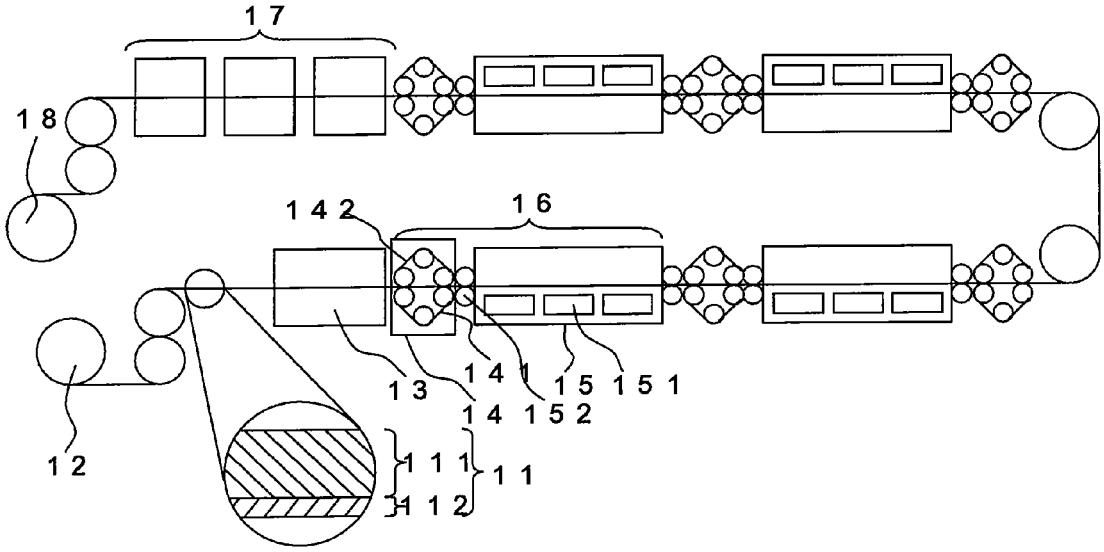
FIG. 1 is a schematic process diagram showing one example of a plating device according to an aspect of the present invention.

11: film equipped with electrically conductive film
12: original fabric roll
13: pre-processing tank
14: power supply portion
15: plating tank
16: plating processing section
17: post-processing tank
18: wind-up roll
111: plastic film
112: film conductive surface
141: power supply electrode
142: reception side rotating body
151: anode
152: seal unit
201*a*: pulley
201*b*: pulley
201*c*: pulley
201*d*: pulley
201*e*: pulley
201*f*: roller-shaped electrode
202*a*: pulley
202*b*: pulley
202*c*: pulley
203: magnetic force generation means
204: small rotating body
205: fluid ejection nozzle
206: fluid
207: support rotating body
301: endless belt made of resin
302: surface layer

303: resistance measuring instrument
401: bracket
402: fixed shaft
403: rotary connector
404: power supply cable
405: power supply electrode
406: conductive surface
407: voltmeter
408: DC power supply
409: magnet
501: slide block
502: bolt
601: bearing
602: automatic core adjustment bearing
603: amount of crown
71: burr
72: warp
73: R chamfering
θ: wrapping angle

DETAILED DESCRIPTION OF THE INVENTION

An example of one embodiment of the present invention will be described below with reference to the drawings using an example in which application is made to manufacturing a plastic film with a copper plated coating film on one side for flexible circuit substrate.

FIG. 1 is a schematic plan view of one example of a continuous electrolytic plating apparatus of a web according to the present embodiment. Such device a multi-stage continuous electrolytic plating apparatus for winding out a long film, performing plating process, and winding up as a product roll. The main steps include a wind-out section 12 for winding out a film equipped with electrically conductive film on one side 11 formed in advance with a very thin electrically conductive film 112 consisting of copper alloy through sputtering method and the like on one side of a plastic film 111 from a wounded-up roll body, a pre-processing cleaning section 13 for performing degreasing and cleaning on the electrically conductive film 112 of the wounded out film equipped with electrically conductive film 11, a plating processing section 16 including a power supply portion 14 for contacting the electrically conductive film 112 and supplying power and a plating processing tank 15, a post-processing section 17 for performing rust prevention to prevent oxidation of the plate film, cleaning, and drying, and a wind-up section 18 for winding up the film finished with the processing. If the electrically conductive film 112 before plating is in a clean state, the pre-processing cleaning section 13 may be omitted, and the post-processing section 17 may be omitted as necessary.

In the plating processing section 16, the film equipped with electrically conductive film 11 is nipped with a power supply electrode 141 contacting the electrically conductive film 112 and a reception side rotating body 142 contacting the plastic film 111 in the power supply portion 14, and power is supplied from the power supply electrode 141 to the electrically conductive film 112, so that the electrically conductive film 112 immersed in the plating bath in the plating processing tank 15 becomes a cathode, an electrical plating circuit is formed with the anode 151, and the plating processing is performed. A slit is formed a the entrance/exit port of the plating processing tank 15 to enable the film to pass through, where a seal unit 152 for suppressing the leakage of the plating solution from the slit and holding the plating solution in the plating processing tank 15 is arranged. The seal unit 152 suitably uses a unit for sandwiching and sealing the film with two elastic rollers such as a rubber roller and a unit for controlling the gap between the two plates and controlling the liquid leakage amount. Basically, the wind-out section 12 and the wind-up section 18 are responsible for the so-called running of the film such as applying tension to the film 11 and determining the running speed, but in addition, the seal unit 152, the power supply electrode 141, and the like may be associated with the running of the film.

The thickness of the plastic film 111 of the inserted film equipped with electrically conductive film 11 is suitably between 5 μm and 80 μm. Various resins such as vinyl resin, aramid resin and nylon resin are used for the material, but among them, polyester resin and polyimide resin are suitably used, and in particular, polyimide film is preferably used for the product that requires heat resistance such as semiconductor package application. Various methods such as a method of laminating the electrically conductive film to the film with an adhesive, and a method of directly forming a film on the film through any methods of sputtering method, deposition method and the like can be applied for the method for forming the electrically conductive film 112, but the heat resistance temperature of the adhesive is often lower than the heat resistance temperature of the film in the method of laminating using the adhesive, and thus the method of directly forming the electrically conductive film on the film is preferable from the standpoint of heat resistance property and a method of forming a film through sputtering method is more preferable from the standpoint of ensuring high close attachment property of the electrically conductive film with respect to the resin film. If the film thickness of the electrically conductive film is smaller than or equal to 0.005 μm, the film is often not uniformly formed, and is formed in an island-shape or a portion where film is not formed produces, and thus the film thickness of the electrically conductive film 112 of greater than or equal to 0.005 μm is suitably used. The thickness is preferably greater than or equal to 0.08 μm so that the electrical resistance of the electrically conductive film can be reduced and a large current can be flowed without damaging the electrically conductive film, and smaller than or equal to 0.25 μm from the standpoint of productivity. The sputtering process is generally low in productivity as great amount of cost and time are consumed to form a thick film.

Figure 2A:
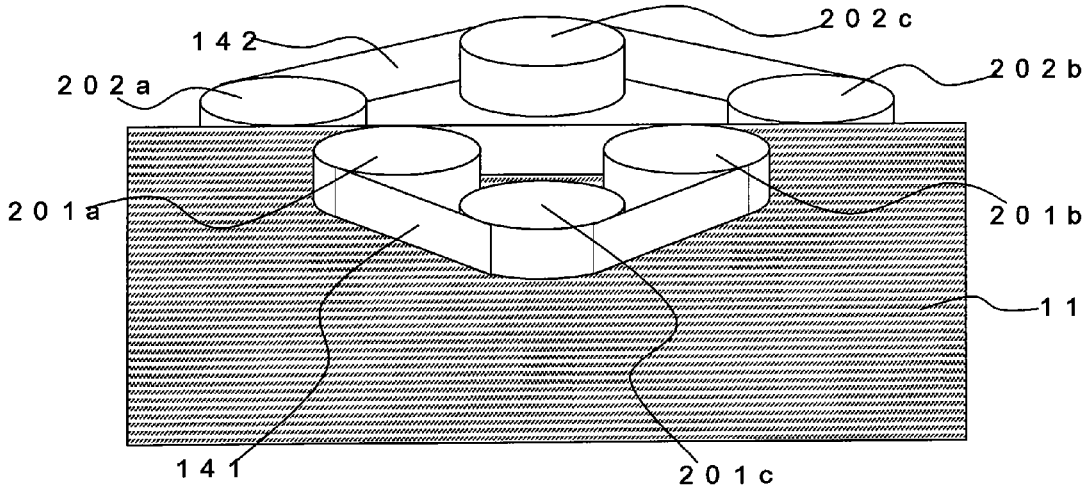
FIG. 2*a* is a schematic perspective view showing one example of a power supply portion according to an aspect of the present invention.
Figure 2B:
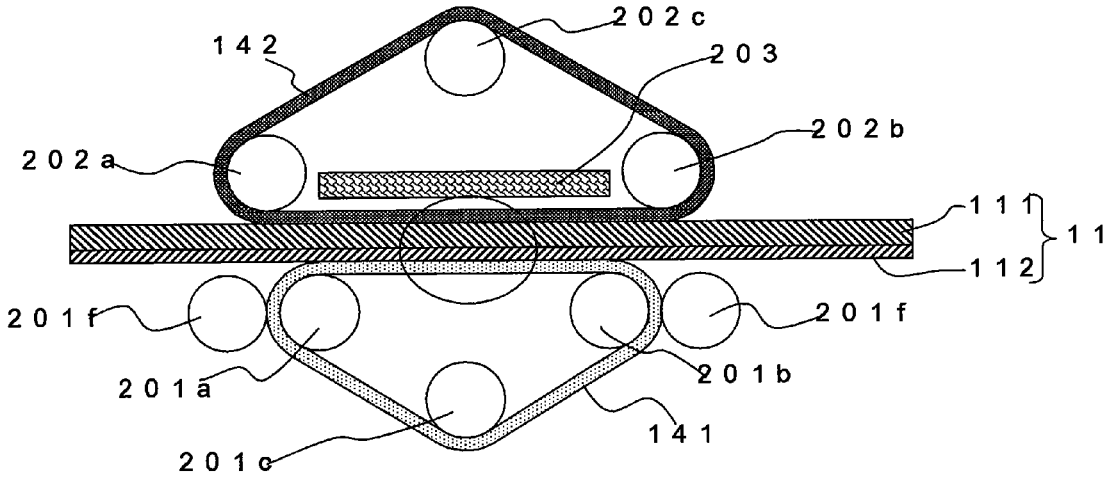
FIG. 2*b* is a schematic view seen from the upper side in a vertical direction of one example of the power supply portion according to an aspect of the present invention.

One example of the power supply portion 14 will be shown in a schematic perspective view enlarging the vicinity of the electrode in FIG. 2*a* and in a schematic view seen from the upper side in the vertical direction in FIG. 2*b*. The power supply electrode (first belt-shaped annular body) 141 electrically connected with a plating power supply is arranged to contact the film conductive surface 112 of the film equipped with electrically conductive film 11, pulleys 201*a*, 201*b*, 201*c* for holding the power supply electrode 141 and applying tensile force to guide the rotation are arranged to internally contact the power supply electrode 141, a second belt-shaped annular body is used as the reception side rotating body 142 so as to face the power supply electrode 141 with the film equipped with electrically conductive film 11 in between, and pulleys 202*a*, 202*b*, 202*c* for holding the same and applying tensile force to guide the rotation are arranged. The connection of the plating power supply and the power supply electrode 141 may be of any connection as long as electrical connection is made, and for example, a method of contacting an electrode plate connected to the plating power supply or a brush-shaped electrode to the power supply electrode 141, and supplying power while sliding is used, from a method of contacting a roller-shaped electrode 201*f* capable of carrying current while rotating to the power supply electrode 141 and flowing current is preferable from the standpoint of preventing wear and dust production by scratches, where the power supply electrode 141 is preferably configured with only metal having conductivity so that the inner peripheral surface and the outer peripheral surface are not insulated, whereby the number of components can be reduced by connecting the power supply to the pulleys 201*a*, 201*b*, 201*c* and the like, and the structure can be simplified. In this case, the material of the pulley to be connected with the power supply is suitably metal material of low volume resistivity such as copper and silver.

Figure 3A:
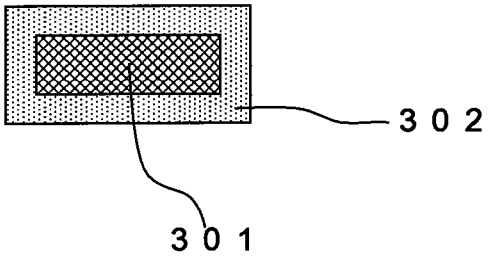
FIG. 3*a* is a cross-sectional view showing one example of a structure of the power supply electrode according to an aspect of the present invention.
Figure 3A:
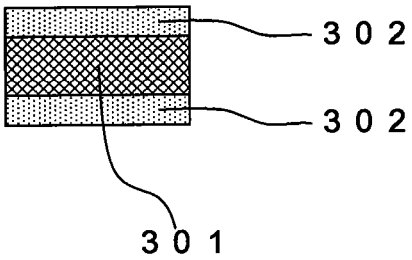
Figure 3C:
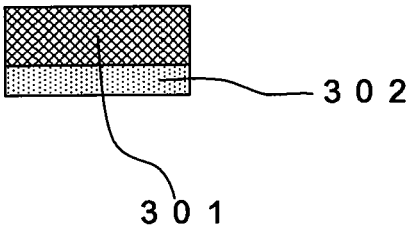
FIG. 3*c* is a cross-sectional view showing another example of a structure of the power supply electrode according to an aspect of the present invention.
Figure 3D:
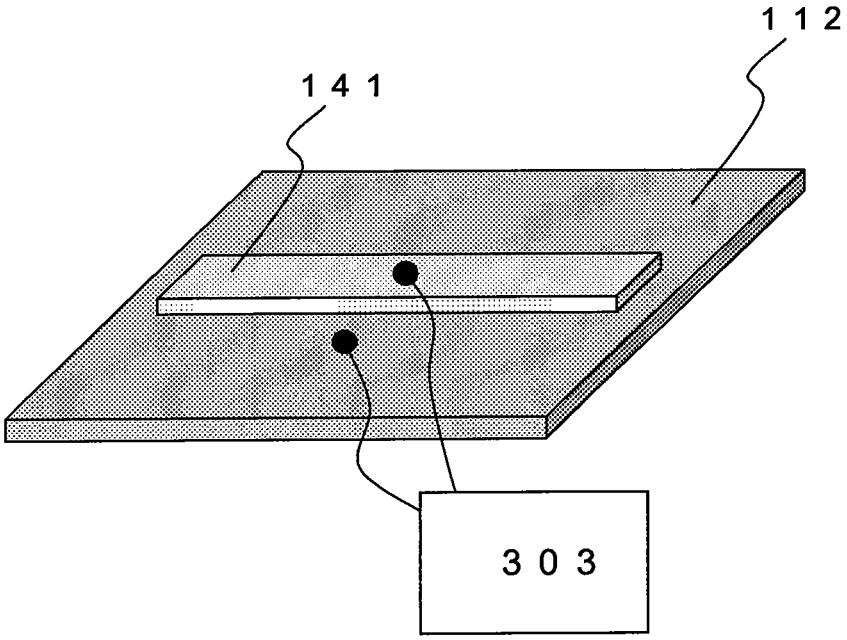
FIG. 3*d* is a wiring conceptual view showing a measurement method of an electrical resistance of a power supply electrode and a film conductive surface.

The power supply electrode 141 is a belt-shaped annular body having conductivity. For instance, that which is metal coated, that which is formed to an annular shape by connecting both ends of a metal belt, or that which has a metal film formed to an annular shape through methods such as electrotyping is preferably used to provide conductivity to a surface layer 302 of an endless belt 301 made of resin such as rubber, as shown in cross-sectional views in FIGS. 3*a*, 3*b*, and 3*c*, where the portion to be provided conductivity to reduce the electrical resistance more preferably uses alloy of low resistivity or pure metal. The electrical resistance is obtained by contacting the power supply electrode 141 to the film conductive surface 112 as shown in FIG. 3*d* and measuring the resistance value of the film conductive surface 112 and the power supply electrode 141 while applying a defined contacting pressure. In this case, a numerical value close to the contact resistance value is obtained by measuring a close as possible point of the film conductive surface 112 and the power supply electrode 141. The electrical resistance measured in such manner is smaller than or equal to 500 mΩ and more preferably smaller than or equal to 100 mΩ from the standpoint of alleviating thermal damage by Joule heat and alleviating power loss. The tensile force applied on the power supply electrode 141 is preferably very low of an extent the electrode does not slip down. This is to use the force received by the contact surface of the power supply electrode 141 from an area pressure applying means as a contact pressure with the film conductive surface 112 at as high as possible efficiency. The contact pressure between the contact surface of the power supply electrode 141 and the film conductive surface 112 generates by generating an external drag (or opposite action) for inhibiting displacement with respect to the force of displacing the contact surface of the power supply electrode 141 to the film conductive surface 112 side, but if the tensile force of the power supply electrode 141 is high in this case, most of the force received by the area pressure applying means is used to cancel out the internal drag by the tensile force to inhibit the displacement, whereby the force for displacement becomes small and the contact pressure consequently becomes small. If the contact pressure is too small or if the contact pressure is not applied at all, the plating solution may be sandwiched between the power supply electrode and the film conductive surface. In this case, the plated metal precipitates as the plating circuit forms between the power supply electrode and the film conductive surface. Thus, a large contact pressure is preferably applied. The contact surface of the power supply electrode 141 with the film conductive surface 112 needs to be in area contact. The size of the contact area is preferably greater than or equal to the numerical value of equation 2 from the standpoint of suppressing heat generation. The details will be hereinafter described.

[Equation 3]

$$A \geqq \frac{I^2 \cdot R}{Q_L \cdot t} \qquad \text{(Equation 2)}$$

A: contact area [$mm^2$] of contact surface to surface of conductive thin film

I: current value [A] to be input

R: contact resistance value [Ω] of contacting part t: film thickness [mm] of electrically conductive film to which the contact surface contacts $Q_L$: limit heat quantity coefficient [$W/mm^3$]=$8.5\times10^3$ $W/mm^3$ Larger contact area is advantageous with respect to heat generation, but since influence of heat generation is barely found when exceeding a size of a certain extent, the contact area is efficiently and more preferably within the range of equation 1 according to the knowledge of the inventors obtained from experiments. In the equation, the limit heat quantity coefficient $Q_L$ is $8.5\times10^3$ [$W/mm^3$] according to the knowledge of the inventors obtained as a result of experiments, but more preferably $1.0\times10^3$ [$W/mm^3$] in view of safety coefficient. The contact area is obtained by the product of the length in the film width direction of the contact surface and the length in the film running direction. The contact surface length in the film width direction is preferably as small as possible since the range that contacts the film conductive surface becomes small and many surfaces with fewer contacting scratches etc. can be obtained. However, an accurate contact may not be obtained due to meandering of the film and mechanical error if the contact surface length in the film width direction is too small, and thus the contact surface length is preferably greater than or equal to 3 mm and smaller than or equal to 15 mm. The length in the running direction may be appropriately set such that the contact area is within the range of the equation 1. The surface roughness of the surface that contacts the film conductive surface 112 of the power supply electrode 141 is preferably Ra=0.1 μm to 50 μm in arithmetic average roughness defined in JIS B0601-2001. The surface with large bumps, that is, the surface with large arithmetic average roughness has a large surface area and thus contributes to increase in the contact area, but the contact area actually becomes small as the film conductive surface cannot closely attach to the bumps of the contact surface if the bumps are too large. Ra=0.8 to 6.3 μm is more preferable to ensure the contact area with an appropriate pushing pressure.

The example of FIG. 2*b* is an example using a magnetic force generation means 203 for the area pressure applying means for applying area pressure on the contact surface of the power supply electrode 141 with respect to the film conductive surface 112. In this case, material having magnetic property such as nickel and iron is used for the power supply electrode 141 to provide magnetic property, and a permanent magnet or the like is arranged on the reception side rotating body 142 side as the magnetic force generation means 203. The magnetic force generation means 203 merely needs to generate magnetic force such as an electromagnet, but permanent magnets such as ferrite magnet, neodymium magnet and cobalt magnet are preferable as they are inexpensive, and among them, the neodymium magnet is more preferable due to it high magnetic flux density.

Figure 7A:
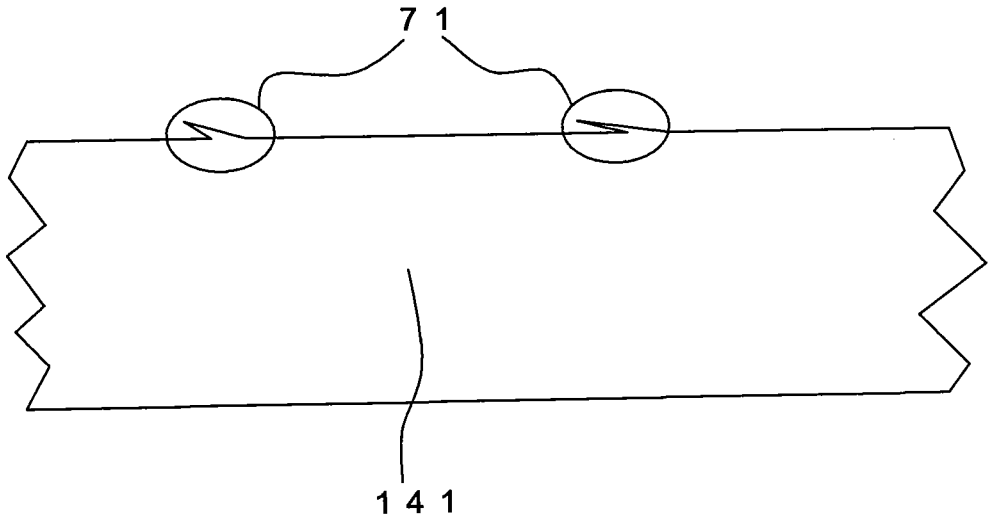
FIG. 7*a* is a conceptual view of a plan view showing a burr at the edge on both ends in the width direction of the belt-shaped annular body.
Figure 7B:
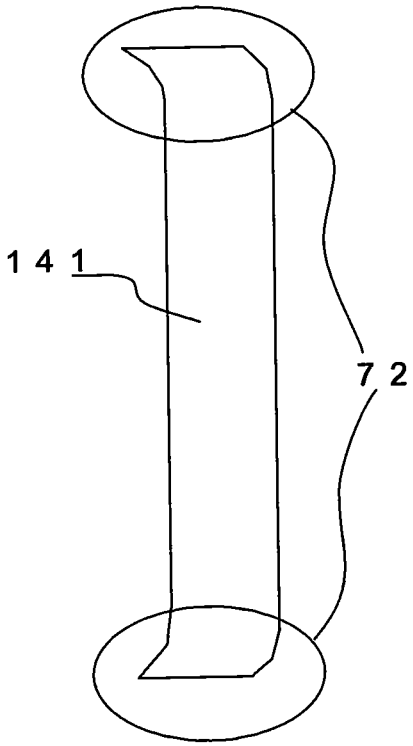
FIG. 7*b* is a conceptual view of a cross-sectional view showing the warp at the edge on both ends in the width direction of the belt-shaped annular body.
Figure 7C:
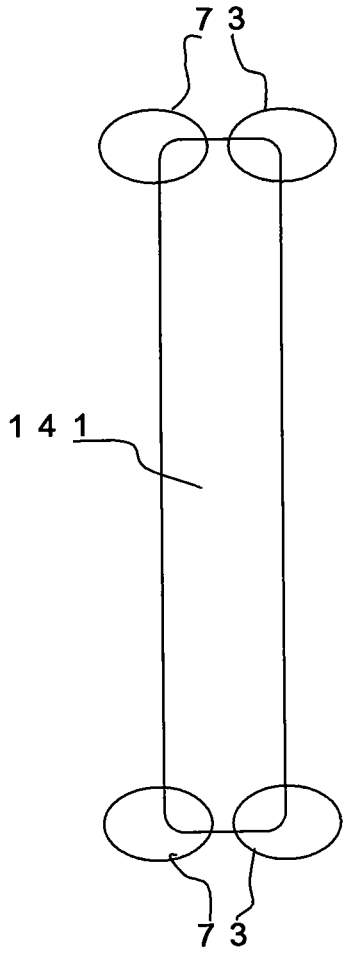
FIG. 7*c* is a conceptual view of a cross-sectional view showing one example of a preferable shape of the edge on both ends in the width direction of the power supply electrode according to an aspect of the present invention.

In this case, the power supply electrode 141 is made of magnetic material, but since the magnetic material often does not have corrosion resistance, there are many cases where the power supply electrode 141 cannot be used due to corrosion at a relatively early time. Therefore, metal material having both conductivity and corrosion resistance such as gold, platinum, iridium, ruthenium, rhodium, palladium, hafnium, tantalum, tungsten, titanium, cobalt, zirconium, and niobium, or the alloy thereof is preferably coated on the surface. In the present embodiment, for the evaluation of the corrosion resistance, evaluation is made that corrosion resistance is provided when immersed for 24 hours in the copper sulfate plating solution containing 100 g/L to 300 g/L of copper sulfate, 10 g/L to 150 g/L of sulfuric acid, and 1 mg/L to 100 mg/L of chlorine and the weight change rate of before and after immersion is less than 1%. Since the corrosion resistance with respect to the solution to be actually used is important in one aspect, the corrosion resistance is desirably evaluated similar to the method of this time using the plating solution to be actually used. With respect to conductivity, the material other than the material which volume resistivity is greater than or equal to $1\times10^{6}$ Ω·m generally called an insulating body is assumed to have conductivity, where the material having a volume resistivity of smaller than or equal to $1\times10^{-6}$ Ω·m is preferable from the standpoint of reducing the Joule heat. As a coating method, a method such as deposition, spraying, and plating is suitably used. The film thickness of the coating film may generate heat if too thin as a large amount of current needs to be flowed to the thin film due to its configuration. The film thickness is thus preferably greater than or equal to 0.5 μm. If the film thickness is too thick, cracks may form at the surface due to bending stress, and in the worst case, stripping may occur, and thus the film thickness is preferably smaller than or equal to 1 mm. The film thickness range more preferable for suppressing heat generation and preventing breakage of the film is greater than or equal to 1 μm and smaller than or equal to 30 μm. At the stage the belt-shaped annular body is formed with the magnetic material, a sharp projection 71 generally called the burr remain, as shown in FIG. 7*a*, or a raised portion 72 generally called the warp forms, as shown in FIG. 7*b*, when the edge on both ends in the width direction is microscopically seen. FIG. 7*a* is a conceptual view of a plan view showing the burr at the edge on both ends in the width direction of the belt-shaped annular body, and FIG. 7*b* is a conceptual view of a cross-sectional view showing the warp at the edge on both ends in the width direction of the belt-shaped annular body. Such portions tend to become the starting point of the stripping of the coating film at the surface when receiving stress with the rotation of the power supply electrode 141, and in particular, tend to have a thicker film thickness than other portions as electrical field tends to concentrate at the burr and the warp when coating through electrolyte plating method and tend to break when the bending stress generates. If breakage of the coating film occurs, corrosion easily advances from the relevant portion to the interior magnetic material. Furthermore, once the corrosion starts, the corrosion of the magnetic material advances with increasing speed by local battery effect and the lifespan for the electrode becomes extremely short. R chamfering 73 is preferably performed so that edges are not formed as much as possible, as shown in FIG. 7*c*. FIG. 7*c* is a conceptual view of a cross-sectional view showing one example of a preferable shape of the edge on both ends in the width direction of the power supply electrode according to the present embodiment.

Figure 2C:
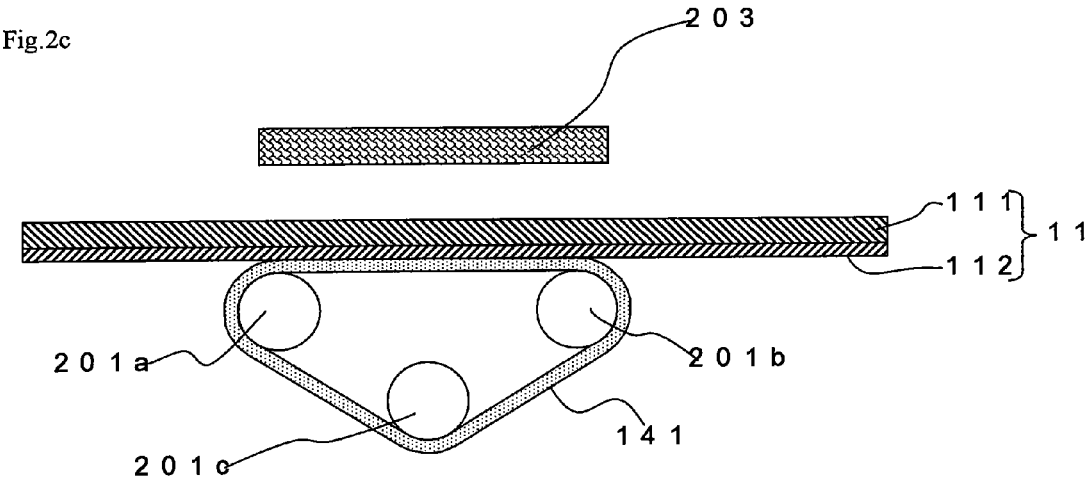
FIG. 2*c* is a schematic view seen from the upper side in a vertical direction of one example of another power supply portion according to an aspect of the present invention.
Figure 2D:
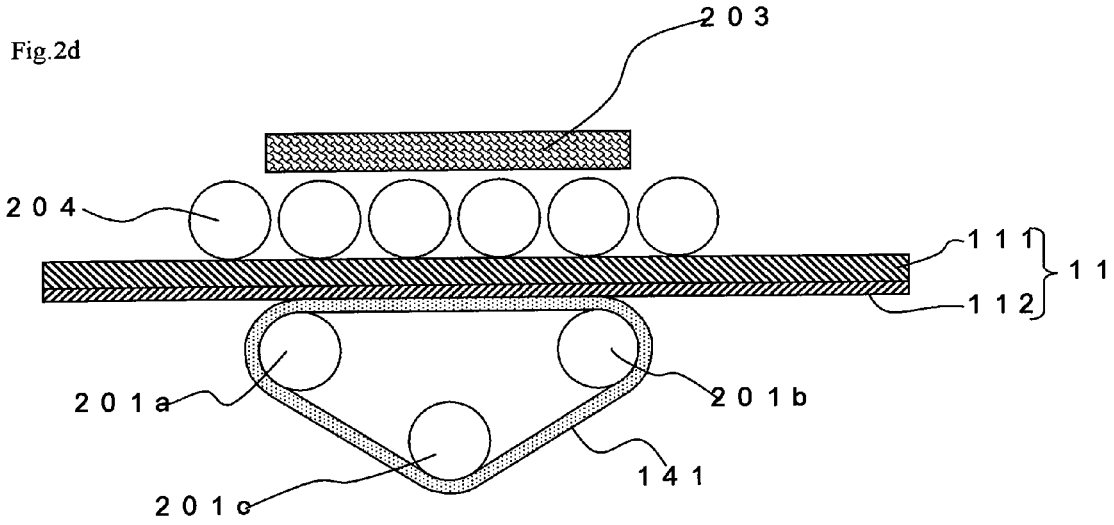
FIG. 2*d* is a schematic view seen from the upper side in a vertical direction of one example of another power supply portion according to an aspect of the present invention.
Figure 2E:
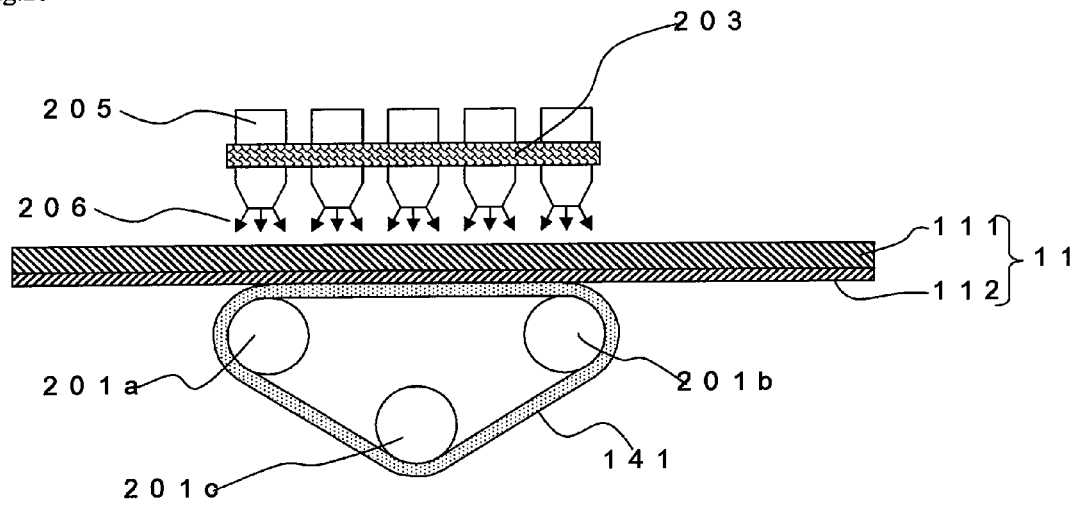
FIG. 2*e* is a schematic view seen from the upper side in a vertical direction of one example of another power supply portion according to an aspect of the present invention.
Figure 2F:
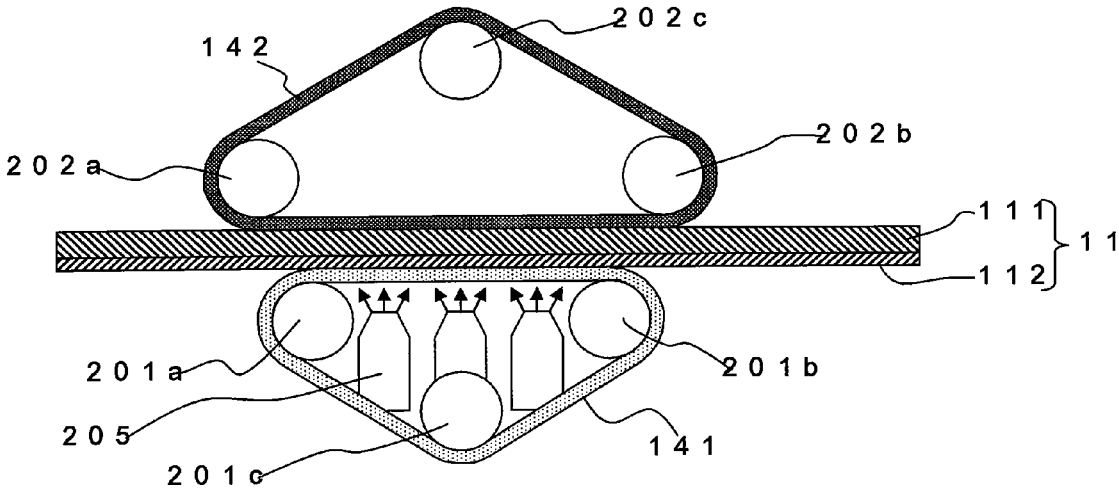
FIG. 2*f* is a schematic view seen from the upper side in a vertical direction of one example of another power supply portion according to an aspect of the present invention.
Figure 2G:
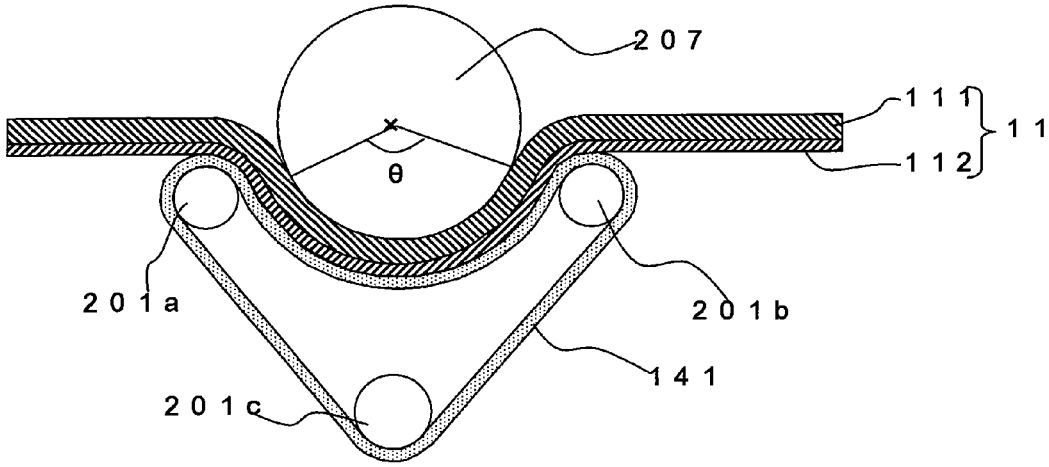
FIG. 2*g* is a schematic view seen from the upper side in a vertical direction of one example of another power supply portion according to an aspect of the present invention.
Figure 2H:
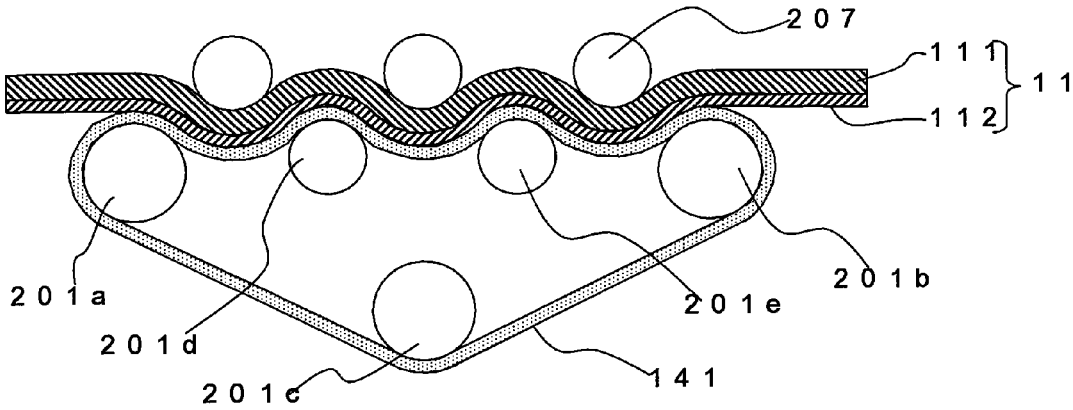
FIG. 2*h* is a schematic view seen from the upper side in a vertical direction of one example of another power supply portion according to an aspect of the present invention.

With respect to the area pressure applying means, a method shown in FIG. 2*f* of blowing fluid such as plating solution or air towards the reception side rotating body 142 side from the back surface (pulley 201*c* side) of the power supply electrode 141 may be used other than the method of using magnetic force. In this case, the mechanical structure can be simplified and the adjustment of the contact pressure can be easily carried out. As shown in FIG. 2*g* and FIG. 2*h*, a method of wrapping the power supply electrode 141 to a support rotating body 207 along with the film equipped with electrically conductive film 11 while applying a wrapping angle θ, and ensuring the pressing pressure by applying tensile force on the power supply electrode 141 can also be adopted. In such method, a special mechanical element for applying the area pressure is not necessary and the mechanical structure can be simplified. Elements which use magnetic force as shown in FIG. 2*b*, elements which use fluid as shown in FIG. 2*f*, or elements which use wrapping as shown in FIG. 2*g* and FIG. 2*h* can be combined. The area pressure for pressing the contact surface of the power supply electrode 141 against the film conductive surface 112 is thereby applied on substantially the entire contact surface of the power supply electrode 141 with respect to the film conductive surface 112 according to the means illustrated above. In the case of the structure shown in FIG. 2*g*, the contact area barely changes even if the role of the support rotating body 207 and the power supply electrode 141 are interchanged, and thus the support rotating body 207 may be arranged on the film conductive surface 112 side so that current is carried from the support rotating body 207.

Figure 2I:
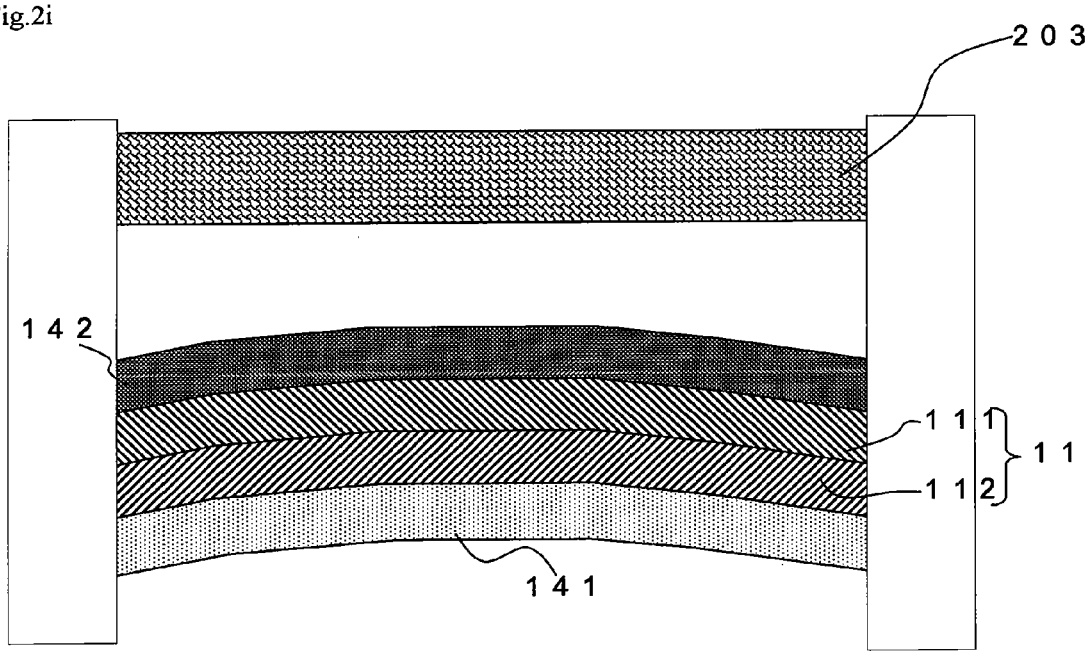
FIG. 2*i* is a schematic view in which a power supply electrode contact portion of FIG. 2*b* is enlarged.

Description now returns to FIG. 2*b*. In the example of FIG. 2*b*, the reception side rotating body 142, which is a reactive force applying means, is preferably set to a tensile force higher than the tensile force of the power supply electrode 141. A schematic view enlarging the contacting portion (circle) in FIG. 2*b* is shown in FIG. 2*i*. The power supply electrode 141 of low tensile force contacts the film equipped with electrically conductive film 11, and at the same time, pressure is generated between the reception side rotating body 142 and the power supply electrode 141 when being attracted to the reception side rotating body 142 side by the magnetic force generated by the magnetic force generation means 203, and the contact pressure is generated between the film equipped with electrically conductive film 11 and the power supply electrode 141. In FIG. 2*b*, the distance between the pulley 202*a* and the pulley 202*b* is preferably the same or longer than the distance between the pulley 201*a* and the pulley 201*b*. This is so that the pressure with the reception side rotating body 142 is generated over the entire contact surface of the power supply electrode 141 with respect to the film conductive surface 112. If the tensile force in the running direction applied on the film equipped with electrically conductive film 11 is high or the rigidity is high and thus is less likely to deflect, a configuration in which the reception side rotating body 142 is not arranged as shown in FIG. 2*c* may be adopted. A configuration shown in FIG. 2*d* in which a small rotating body 204 is lined may be adopted, in which case, the mechanical structure for guiding the running of the reception side rotating body 142 of FIG. 2*b* is unnecessary and the device can be simplified. The structure shown in FIG. 2*e* in which the reactive force is generated by blowing fluid such as plating solution and air may be adopted, in which case, the magnitude of the reactive force can be arbitrarily adjusted and the mechanical structure can be simplified. Such elements may be combined. The small rotating body 204 may be a sphere or a cylinder, but a cylindrical rotating body is preferably used so that the reactive force can be generated with as large as possible surface.

Figure 5:
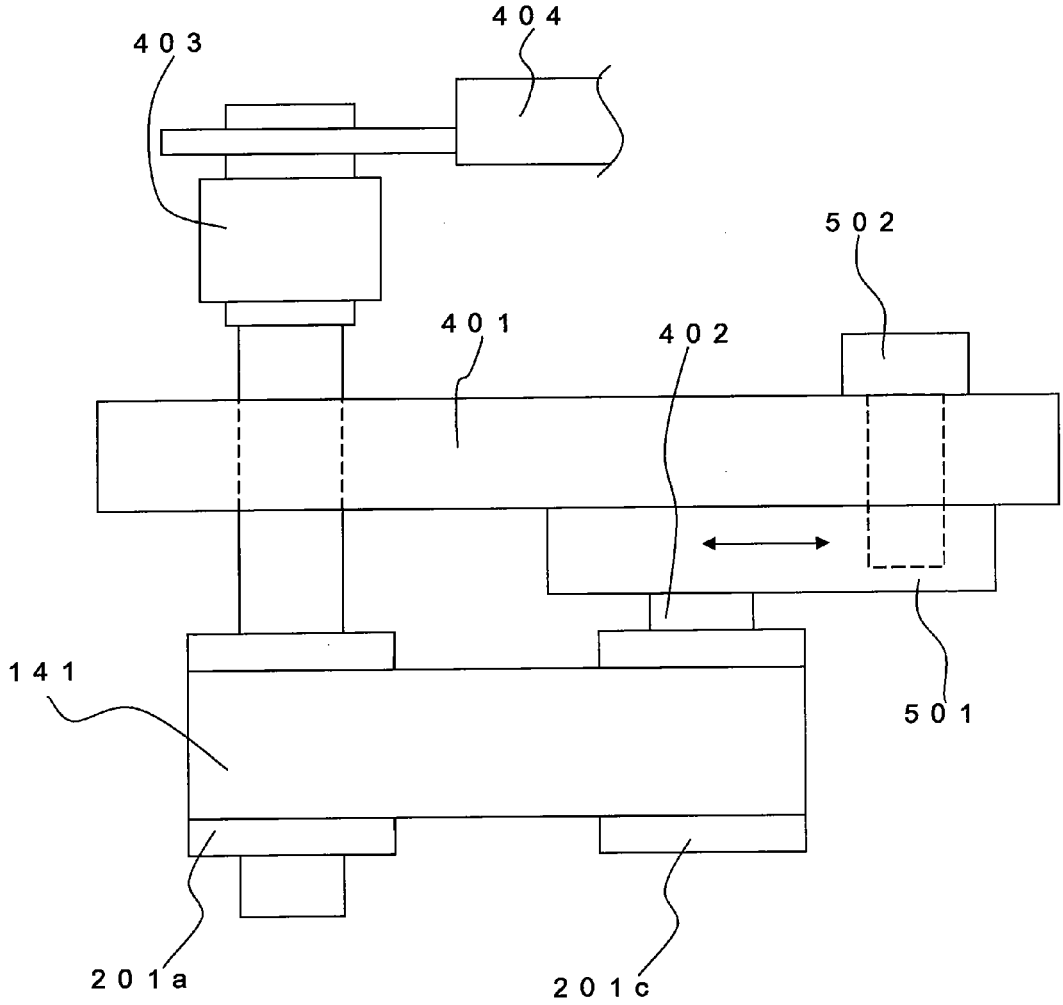
FIG. 5 is a schematic view showing one example of a tensile force applying mechanism on the power supply electrode according to an aspect of the present invention.
Figure 6A:
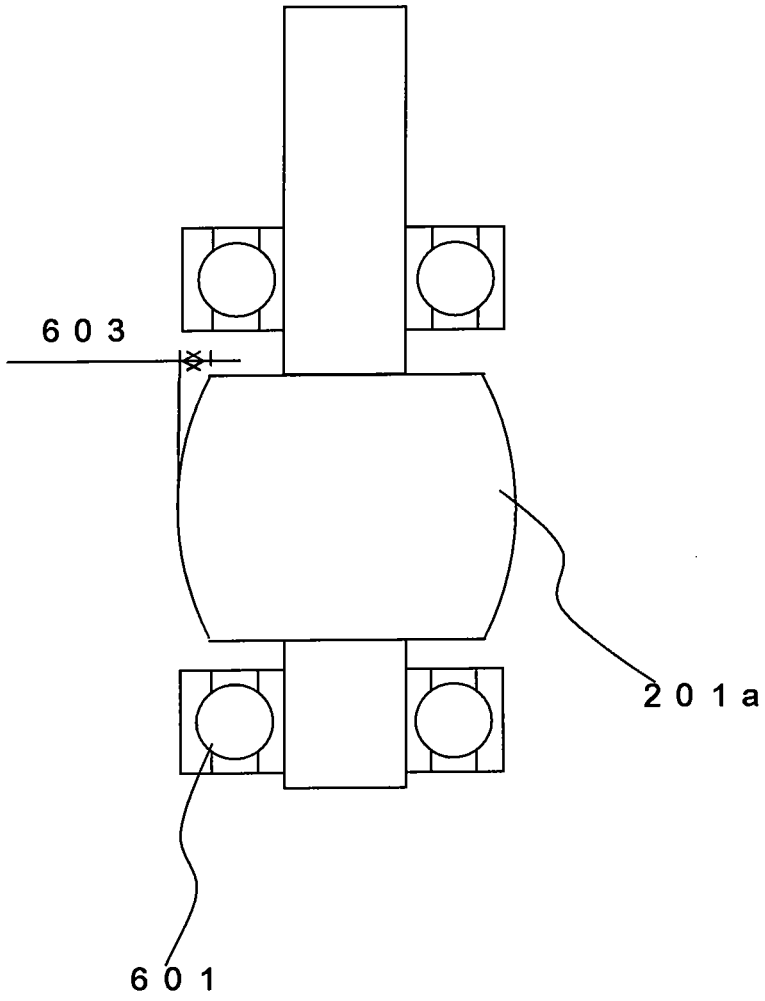
FIG. 6*a* is a schematic cross-sectional view showing one example of a schematic structure of a pulley in an aspect of the present invention.
Figure 6B:
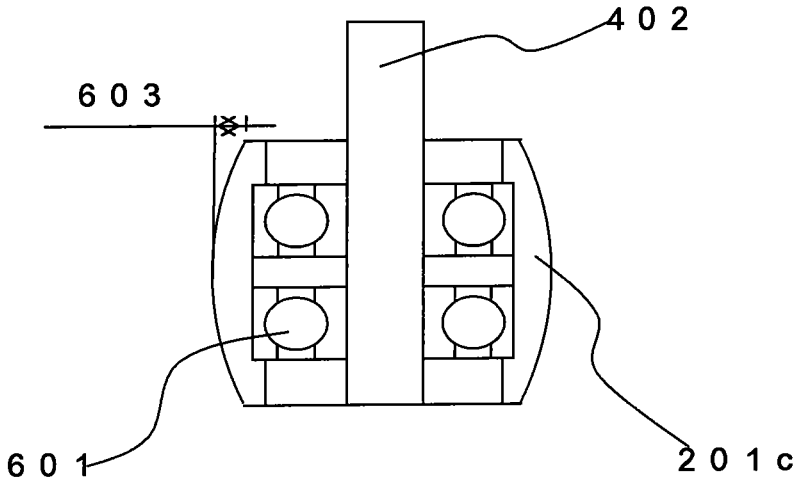
FIG. 6*b* is a schematic cross-sectional view showing another example of a schematic structure of the pulley in an aspect of the present invention.
Figure 6C:
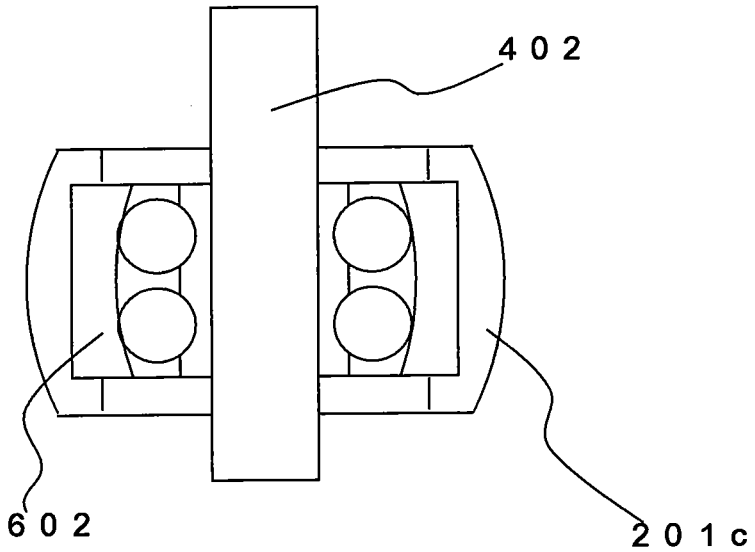
FIG. 6*c* is a schematic cross-sectional view showing another example of a schematic structure of the pulley in an aspect of the present invention.

Description now returns to FIG. 2*b*. In FIG. 2*b*, the contact surface with the film conductive surface 112 of the power supply electrode 141 between the pulleys 201*a* 201*b* becomes the surface that actually exchange electrons. If the contact area of such portion is small, heat generates when carrying current by the Joule heat due to contact resistance, and thus change in color and alteration occur near the contacting part, and in the worst case, burnout of the electrically conductive film may result. The contact area of the contacting part is preferably greater than or equal to the numerical value of equation 2. The limit heat quantity coefficient $Q_L$ in the equation is an experiment value related to the heat generation amount per unit volume of the upper limit that does not adversely affect the product obtained by the inventors as a result of thorough review. To suppress meandering of the power supply electrode 141, crown processing, as shown in the schematic cross-sectional view of FIG. 6*a*, is preferably performed on at least one of the pulleys 201*a*, 201*b*, 201*c*. More preferably, a mechanism of holding the pulley itself so as to be freely tiltable by using an automatic core adjustment bearing 602 for a bearing for rotatably attaching the pulley 201*c* to a fixed shaft 402, as shown in the schematic cross-sectional view of FIG. 6*c*, and the like is preferable from the standpoint of preventing meandering, but such case is suitably adopted to the pulley that is not contacting the film conductive surface 112. If the shape of the power supply electrode 141 is the V-belt shape described in JIS-K6323-1995, the meandering can be prevented by having the shape of the pulley as the V-pulley shape described in JIS-B1854-1987. A mechanism for adjusting the interval between any pulleys is suitably used to adjust the tensile force applied on the power supply electrode 141. The schematic structure of one example is shown in FIG. 5, where FIG. 5 is a schematic view of when the portion below the film conductive surface 112 of FIG. 2*c* is seen from the left of the figure. A mechanism of changing the pulley interval by moving the slide block 501 in the left and right direction in the figure and applying tensile force on the power supply electrode 141, and fixing the same by tightening a bolt 502 while applying an appropriate tensile force is suitably used. A light tensile force of an extent the power supply electrode 141 does not slip down is preferably applied on the power supply electrode 141. In addition, a method of adjusting the pulley interval using an eccentric cam, or a mechanism of applying tensile force using spring, air pressure, and the like is suitably used. Such tensile force applying mechanism may be used on one of the pulleys, and is preferably used on a location that is not contacting the film conductive surface 112 such as the pulley 201*c* so that the contact area etc. does not change every time the tensile force is adjusted. The presence of drive of the pulleys 201*a*, 201*b*, 201*c* is irrelevant, but the pulleys are preferably rotatably supported by the bearing 601 to driven rotate with the film, as shown in schematic cross-sectional views of FIGS. 6*a* and 6*b*, from the standpoint of simplifying the device, where a power source such as a motor may be connected to the upper end portion of the pulley 201*a* by way of a belt, a gear, a friction plate and the like using the structure shown in FIG. 6*a* and a drive of an extent of resupplying torque to compensate for the inertia of the rotating body such as the power supply electrode 141 and the mechanical loss by the sliding resistance etc. is preferably applied from the standpoint of stabilizing the running. Since the pulley is contacting the power supply electrode, the pulley itself or the bearing or the shaft is preferably configured from ceramic, resin, and the like to electrically insulate the power supply electrode and the device member. In this case, ceramic is more preferably used than resin since high processing accuracy is desired for the pulley, the bearing, and the shaft.

Through the use of the above power supply electrode for the power supply electrode of the plating device, the plate film having a very high surface quality of the portion the power supply electrode does not contact is preferably formed. The product of very high product is obtained by setting the contacting part of the power supply electrode 141 and the film conductive surface 112 to outside the productization range, and thus is preferable. In this case, the precipitation of the plated metal to the power supply electrode can be suppressed if the power supply electrode is arranged exterior to the plating tank, and thus an additional facility such as electrolyte plating step becomes unnecessary, which is preferable.

Furthermore, the plating solution level is locally lowered in the plating tank to expose the film conductive surface, where if the power supply electrode is arranged to contact thereto, the influence of the film resistance of the film conductive surface can be suppressed to a minimum even in a long plating tank, and thus is preferable.

In a multi-stage plating device as shown in FIG. 1, a compact design can be made with a requisite minimum size, and is preferable in terms of device cost by increasing the contact area of the power supply electrode 141 in the first half of the plating in which the film thickness of the electrically conductive layer of the film conductive surface 112 is thin and reducing the contact area towards the downstream side.

Since the plating surface formed in the plating device has a very high surface quality, use is suitably made in manufacturing the plate film equipped plastic film for flexible circuit substrate application which is demanded particularly high surface quality.

According to the present embodiment described above, the plating power supply is connected to the reactive force applying means, the support rotating body, and the like for nipping the belt-shaped annular body or the web with the belt-shaped annular body, and used as the plating power supply electrode, so that the electrode can be stably closely attached to the web conductive surface and the contact resistance of the electrode and the web conductive surface can be suppressed to thereby suppress change in color, alternation of the film by heat generation near the electrode, burnout, and the like, and furthermore, the precipitation of the plated metal to the electrode can be suppressed as the plating solution barely enters between the electrode and the web conductive surface, whereby a plate film of extremely high surface quality can be formed.

Furthermore, since the power supply electrode is a rotating body, the generation of force that inhibits the running of the web can be suppressed to enable stable running, and generation of contamination such as abrasion powder etc. can be suppressed.

According to the present embodiment, the size of the power supply device itself can be miniaturized as the size of the power supply electrode itself can be miniaturized. This leads to taking the plating processing tank longer even in the entire length of the same device, and contributes to enhancement of productivity and reduction in device cost.

According to the present embodiment, the power supply performance stabilizes as the precipitation of the plated metal to the power supply electrode itself is suppressed, the additional step such as deplating step becomes unnecessary by arranging the power supply electrode only at the exterior of the plating processing tank, which contributes to reduction in the device cost. As the plating process is also performed on the region where the power supply electrode contacts, heat generation caused by the film resistance of the contacting part of the power supply electrode can also be suppressed.

Furthermore, according to the present embodiment, the power can be supplied in the plating tank while suppressing precipitation of the plated metal to the power supply electrode itself by locally lowering the plating solution level in the plating processing tank and arranging the power supply electrode so as to contact the exposed web end. Thus, the influence of the resistance of the electrically conductive film of the web can be minimized even in a long plating tank, and the current density distribution can be optimized, whereby the productivity can be enhanced.

Furthermore, the present embodiment is suitable for manufacturing the plate film equipped plastic film as the plastic film, which is a soft web, can be stably run. Moreover, an embodiment of the present invention is particularly suitable in a case of plating the copper that is relatively soft and tends to produce scratches, where the surface defect suppression effect and the web running stability effect of the present invention are most obtained in the manufacturing of the flexible circuit substrate which is demanded high surface quality.

EXAMPLE

Aspects of the present invention will be described in detail with the following specific examples. It should be recognized that the present invention is not limited to such specific examples.

Example 1

Figure 4A:
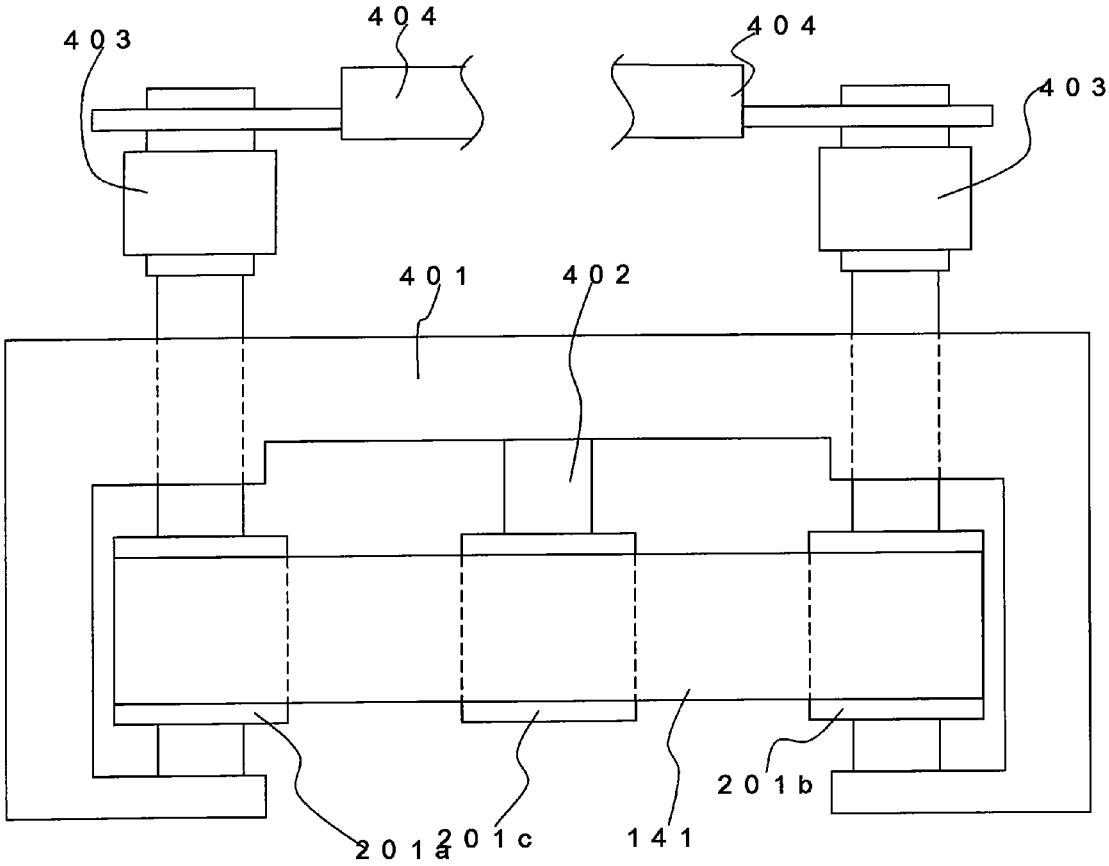
FIG. 4*a* is a schematic view showing a structure of a power supply electrode portion of an example.

The device configuration of the power supply portion is as shown in FIG. 2*b*. A schematic view in which FIG. 2*b* is seen from the lower side of the figure (conductive surface side of the film) is shown in FIG. 4*a*.

An endless belt made of pure nickel having a width of 30 mm and a thickness of 0.1 mm fabricated through electrotyping was used for the power supply electrode 141. The surface roughness was 0.8 μm in center line average roughness (Ra). The pulleys 201*a*, 201*b* were fabricated using phosphor deoxidized copper C1220, and "rotary connector MODEL 1250-SC" 403 manufactured from US Melcotec Co. was attached on the shaft end on one side to connect with a power supply cable 404 connected to the cathode of the plating power supply. The pulley attached with a bearing at a shaft portion of both ends having a pulley outer diameter of 60 mm, a surface length of 35 mm, and an entire length of 70 mm was used. The crown processing of high-low difference of 0.3 mm was performed on the entire pulley surface. Resin bearing was used for the bearing at the shaft ends, and the bracket 401 for gripping the pulley was fixed so as to be electrically insulated with the bracket main body. The pulley 201*c* was fabricated using SUS304. With the pulley outer diameter as 60 mm and the surface length as 35 mm, the crown processing of high-low difference of 0.3 mm was performed. The pulley 201*c* was attached in a freely rotating/tilting manner to a fixed shaft fixed to the bracket by way of an automatic core adjustment bearing. The tensile force applied on the power supply electrode 141 was set to separate the pulley 201*c* by an extent deflection does not naturally occur between the pulleys. The center-to-center distance of the pulley 201*a* and the pulley 201*b* was 150 mm.

An SUS belt in which both ends of a steel band of SUS304H having a width of 30 mm, and a thickness of 0.1 mm are joined through welding was used for the reception side rotating body 142. Each pulley 202*a*, 202*b* was fabricated with the SUS304, which pulley outer diameter is 60 mm and surface length is 35 mm, and then subjected to the crown processing of a high-low difference of 0.3 mm. The pulleys 202*a*, 202*b* are rotatably attached to the fixed shaft fixed to the bracket by way of a deep groove ball bearing. The pulley 202*c* was fabricated using SUS304. With the pulley outer diameter as 60 mm and the surface length as 35 mm, the crown processing of high-low difference of 0.3 mm was performed. The pulley 202*c* was attached in a freely rotating/tilting manner to a fixed shaft fixed to the bracket by way of an automatic core adjustment bearing. The tensile force of the reception side rotating body 142 was set to separate the pulley 202*c* so as to apply 200 N in calculation. The center-to-center distance of the pulley 202*a* and the pulley 202*b* was 200 mm.

Figure 4B:
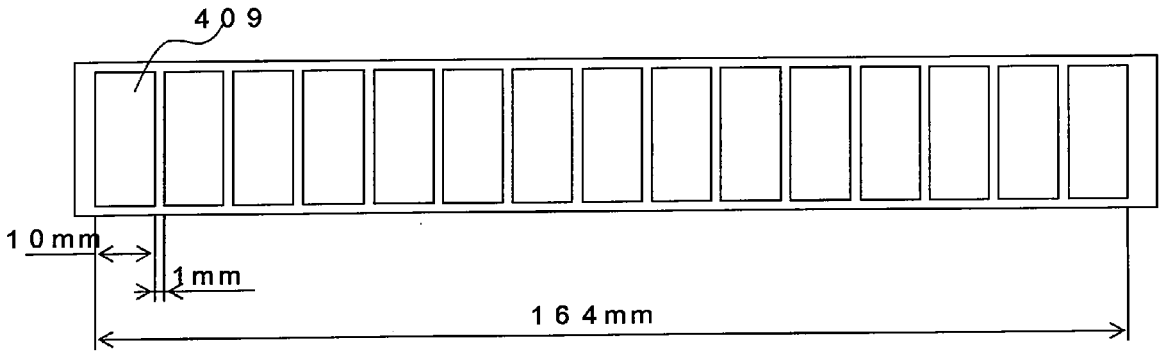
FIG. 4*b* is a schematic view showing a magnet arrangement of the example.

The magnetic force generation means 203 was used for the area pressure applying means. The magnetic force generation means 203 uses 15 of the neodymium magnet, having a width of 30 mm, length of 10 mm, and thickness of 5 mm, of residual magnetic flux density magnetized in the thickness direction of 350 mT arranged lined in the length direction as shown in FIG. 4*b* with a spacing of 1 mm so that all N poles are on the power supply electrode 141 side. As the neodymium magnet easily corrodes and may break down under plating solution scattering environment, the neodymium magnet subjected to nickel plating over the entire surface was used.

The gap between the power supply electrode 141 and the reception side rotating body 142 at the contacting portion of the power supply electrode 141 and the reception side rotating body 142 is adjusted to be zero in a state the film is not sandwiched. The gap between the magnetic force generation means 203 and the reception side rotating body 142 is adjusted to be between 2.5 mm and 3 mm.

Figure 4C:
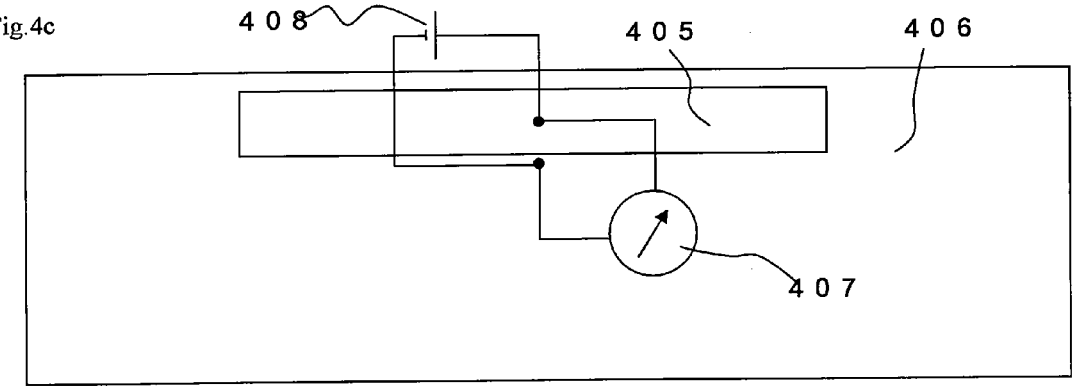
FIG. 4*c* is a schematic view showing a contact resistance measurement method in the example.

The copper plating processing experiment of the polyimide film with electrically conductive film was conducted using the power supply portion 14 for the first plating processing section 16 of the plating device of FIG. 1 for verification of the power supply ability when the electrically conductive film is the thinnest, and for the last plating processing section 16 of FIG. 1 for verification of the power supply ability when the input current is the largest. The power supply electrode described in Japanese Patent Application No. 2007-076040 filed by the inventors of the present invention was used for the plating processing section 16 sandwiched between the first and the last plating processing sections. The input current of the first plating processing section was set to 20 A, and the input current of the last plating processing section was set to 200 A. The configuration of the input polyimide film with electrically conductive film is such that a copper alloy of 0.1 μm is formed through sputtering method on one surface of the polyimide film "Capton EN" manufactured by Du-Pont Toray Co. having a width of 520 mm, a length of 500 mm, and a thickness of 38 μm. The contact area of the power supply electrode and the film conductive surface was 2250 $mm^2$ and the length in the film width direction of the contact surface was 15 mm for both the first plating processing section and the last plating processing section. For the plating condition, an original fabric was inserted to the plating device and subjected to plating processing to ultimately obtain a copper plate film of 8.5 μm was the production condition, where the film running speed in this case was 1.0 m/min. The surface resistivity of the electrically conductive film formed through the sputtering method complies with the JIS K7194-1994, and was $3.5\times10^{-1}\Omega/\square$ as a result of measuring with surface resistivity measuring instrument "Loresta GP" MCP-T600 manufactured by Mitsubishi Chemical Corporation and the surface resistivity of the electrically conductive film after plating of 8.5 μm was $1.92\times10^{-3}\Omega/\square$. The result of measuring the contact resistance of the electrically conductive film formed through the sputtering method and the power supply electrode was 70 mΩ, and the contact resistance of the electrically conductive film after plating of 8.5 μm and the power supply electrode was 10 mΩ. For the measurement method, a voltmeter 407 and a DC power supply 408 are parallel connected at immediately below a central part in a longitudinal direction of the contacting part of the power supply electrode 405 and the electrically conductive film 406 and at a central part on the back side of the contact surface of the power supply electrode as shown in FIG. 4*c*, and the voltage of when a constant current of 1 A is inserted from the DC power supply 408 was measured to obtain the resistance value from Ohm's law through calculation.

The surface quality of the range of 100 mm×100 mm at the central part of the plating processed sample obtained in the plating processing experiment was checked, but bumps of greater than or equal to height/depth of 2 μm were not found and production of scratches was also not recognized. Furthermore, thermal trouble such as change in color and burnout of electrically conductive film due to heat near the electrode was also not recognized, and a plate film of high quality was recognized to be obtained.

Comparative Example 1

The plating processing experiment similar to the first example was conducted while changing to a method of supplying power with the power supply portion 14 contacted at the entire surface with the cylindrical rotating body as the electrode.

The surface quality of the range of 100 mm×100 mm at the central part of the plating processed sample obtained in the plating processing experiment was checked, and two bumps of greater than or equal to height/depth of 2 μm were respectively produced but production of large scratches was not recognized. However, numerous microscopic cut-like defects were recognized. The thermal trouble such as change in color and burnout of electrically conductive film due to heat near the electrode was not recognized, and the quality of the plate film was not satisfactory.

The present invention is not limited to manufacturing of the film with a copper plated coating film, and can be applied to electrolytic plating apparatus of other metals, electrolytic plating apparatus using base material other than resin film, and the like, but the application range thereof is not limited thereto.

The invention claimed is:

1. A power supply method used in a continuous electrolytic plating apparatus for manufacturing a web with a plated coating film by performing electrolyte plating in a plating processing tank while continuously running a web applied with a conductive thin film on a surface, the method comprising the steps of:

pressure welding a first belt-shaped annular body to the web, the first belt-shaped annular body having a contact surface rotating with the web, wherein an area pressure for pressure welding to the web side is applied with respect to the contact surface of the first belt-shaped annular body; and supplying power to a conductive surface of the web through the first belt shaped annular body using a body which contact surface with the web has conductivity and is electrically connected to a plating power supply as the first belt-shaped annular body.

2. The power supply method according to claim 1, wherein a contact area with the web conductive surface of the first belt-shaped annular body is within a range satisfying equation (1):

Where $$\frac{I^2 \cdot R}{Q_L \cdot t} \leqq A \leqq 50000 \qquad \text{[Equation 1]}$$

A: contact area [$mm^2$] of contact surface to surface of conductive thin film;

I: current value [A] to be input;

R: contact resistance value [Ω] of contacting part;

t: film thickness [mm] of electrically conductive film to which the contact surface contacts; and $Q_L$: limit heat quantity coefficient [$W/mm^3$]=$8.5\times10^3$ $W/mm^3$.

3. A power supply method used in a continuous electrolytic plating apparatus for manufacturing a web with a plated coating film by performing electrolyte plating in a plating processing tank while continuously running a web applied with a conductive thin film on a surface, the method comprising the steps of:

pressure welding a first belt-shaped annular body to the web, the first belt-shaped annular body having a contact surface rotating with the web, wherein an area pressure for pressure welding to the web side is applied with respect to the contact surface of the first belt-shaped annular body; and supplying power to a conductive surface of the running web through a reactive force applier using a body which contact surface with the running web has conductivity and is electrically connected to a plating power supply as the reactive force applier, wherein the first belt shaped annular body comprises magnetic material, and the area pressure is applied on the contact surface of the first belt-shaped annular body by a magnetic force towards the web, and wherein a reactive force with respect to the magnetic force is applied by the reactive force applier arranged on an opposite side in a direction of the area pressure of the web.

4. A power supply method used in a continuous electrolytic plating apparatus for manufacturing a web with a plated coating film by performing electrolyte plating in a plating processing tank while continuously running a web applied with a conductive thin film on a surface, the method comprising the steps of:

pressure welding a first belt-shaped annular body to the running web, the first belt-shaped annular body having a contact surface rotating with the running web, wherein an area pressure for pressure welding to the web side is applied with respect to the contact surface of the first belt-shaped annular body; and supplying power to a conductive surface of the running web through a reactive force applier using a body which contact surface with the running web has conductivity and is electrically connected to a plating power supply as the reactive force applier, wherein the area pressure is applied by ejecting fluid from an inner peripheral surface side of the first belt-shaped annular body towards an inner peripheral surface of the first belt-shaped annular body, and wherein a reactive force with respect to the force by the area pressure is applied by a reactive force applier arranged on an opposite side in a direction of the area pressure of the web.

5. A power supply method used in a continuous electrolytic plating apparatus for manufacturing a web with a plated coating film by performing electrolyte plating in a plating processing tank while continuously running a web applied with a conductive thin film on a surface, the method comprising the steps of:

pressure welding a first belt-shaped annular body to the running web, the first belt-shaped annular body having a contact surface rotating with the running web, wherein an area pressure for pressure welding to the web side is applied with respect to the contact surface of the first belt-shaped annular body; and supplying power to a conductive surface of the running web through a support rotating body using a body which contact surface with the running web has conductivity and is electrically connected to a plating power supply as the support rotating body, wherein the support rotating body is arranged so as to be contacted by the first belt-shaped annular body with a wrapping angle with the web sandwiched with an outer peripheral surface of the first belt-shaped annular body to apply the area pressure.

* * * * *